US006802164B1

(12) United States Patent
Newbrough et al.

(10) Patent No.: US 6,802,164 B1
(45) Date of Patent: Oct. 12, 2004

(54) FLOOR WITH EMBEDDED IMAGE AND ASSOCIATED METHOD

(75) Inventors: Bruce E. Newbrough, Tarentum, PA (US); Seth Pevarnik, Greensburg, PA (US)

(73) Assignee: Ardex, L.P., Aliquippa, PA (US)

( * ) Notice: Subject to any disclaimer, the term of this patent is extended or adjusted under 35 U.S.C. 154(b) by 144 days.

(21) Appl. No.: 10/003,546

(22) Filed: Nov. 1, 2001

(51) Int. Cl.[7] ..... E04B 5/00; E04F 15/12

(52) U.S. Cl. ..... 52/311.1; 52/408; 40/615; 156/71; 428/67; 428/542.2

(58) Field of Search ..... 52/311.1, 408; 472/92; 428/542.2, 67; 40/615; 156/71

(56) References Cited

U.S. PATENT DOCUMENTS

| | | | | |
|---|---|---|---|---|
| 1,688,239 | A | * | 10/1928 | Karpf |
| 1,729,834 | A | * | 10/1929 | Jackson |
| 1,729,835 | A | * | 10/1929 | LJackson |
| 2,430,934 | A | * | 11/1947 | Kemmler et al. |
| 2,455,777 | A | * | 12/1948 | Jones |
| 2,683,094 | A | * | 7/1954 | Jones |
| 2,696,452 | A | * | 12/1954 | Trepp |
| 3,109,746 | A | * | 11/1963 | Seedorf |
| 3,157,561 | A | * | 11/1964 | Miller et al. |
| 3,310,422 | A | * | 3/1967 | Petry |
| 3,428,471 | A | * | 2/1969 | Tuthill et al. |
| 3,616,005 | A | | 10/1971 | Wetstone |
| 3,663,353 | A | * | 5/1972 | Long et al. |
| 3,690,914 | A | * | 9/1972 | Andreski |
| 3,787,259 | A | * | 1/1974 | Kleinfeld et al. |
| 4,054,699 | A | * | 10/1977 | Brinkley |
| 4,213,926 | A | | 7/1980 | Toyoda et al. |
| 5,246,518 | A | * | 9/1993 | Hale |
| 5,304,272 | A | * | 4/1994 | Rohrbacker et al. |
| 5,484,638 | A | * | 1/1996 | Crabtree ..... 428/67 |
| 5,693,395 | A | * | 12/1997 | Wine |
| 5,863,632 | A | * | 1/1999 | Bisker |
| 5,989,636 | A | | 11/1999 | Wine |
| 6,041,533 | A | * | 3/2000 | Lemmond |
| 6,332,941 | B1 | * | 12/2001 | Council et al. |
| 2002/0127372 | A1 | * | 9/2002 | Waite et al. |

FOREIGN PATENT DOCUMENTS

JP 10-100358 * 10/1998 ..... B32B/33/00

OTHER PUBLICATIONS 2 pages from www.allprint.co.uk titled Footprint, Floor Graphics System:, no date.*
4 pages from Google search, no date.*
2 pages, from www.bigphoto.com/floorgraphics, no date.*
2 pages from www.lowen.com/products/floor, no date.*

* cited by examiner

*Primary Examiner*—Robert Canfield
(74) *Attorney, Agent, or Firm*—Brij K. Agarwal; Eckert Seamans Cherin & Mellott, LLC

(57) ABSTRACT

A floor includes a substrate and an image, with the image being visible from above the floor. The image is formed on a carrier sheet that is embedded within a coating disposed upon an upper surface of the substrate. The coating is substantially translucent and is highly durable. The carrier sheet becomes substantially invisible when embedded in the coating such that the image remains visible from above the floor and appears to be embedded therein. An associated method is also disclosed.

32 Claims, 2 Drawing Sheets

FLOOR WITH EMBEDDED IMAGE AND ASSOCIATED METHOD

BACKGROUND OF THE INVENTION

1. Field of the Invention

The present invention relates generally to flooring and, more particularly, to a floor that includes an image embedded therein that is visible from above the floor, along with an associated method.

2. Description of the Related Art

Numerous varied types of flooring are known and understood in the relevant art. Floors often include a substrate that is cementitious or wooden and often also include a top treatment in the form of carpet, tile, paint, decorative wood, and the like. Such top treatments are selected according to numerous criteria including aesthetic appearance, comfort, durability, resistance to elements, as well as other factors. For instance, a given structure such as a residence may include multiple different floors such as carpet on a wooden substrate in a bedroom, tile on a wooden substrate in a bathroom, wood parquet tiles on a wooden substrate in a dining area, stone on a cementitious substrate in an entryway, and paint on a cementitious substrate in a garage or basement.

While such various types of floors have been effective for their intended purposes, such floors have not, however, been without limitation. The vast majority of commercially available flooring is mass produced, meaning that a person desiring to install a floor in a structure or otherwise must choose from among the floors that are then currently available with virtually no opportunity to select a custom floor. Even in the circumstance where one selects, for instance, natural stone that will be painstakingly installed by hand, the stone still possesses an appearance that is substantially the same as all of the other stone within the same product line that is provided by a stone quarry or stonemonger. Alternatively, while numerous shades of carpet are commercially available, such carpets typically have an appearance that is calculated to appeal to a wide variety of potential purchasers and thus are likewise generally unsuited to applications in which a highly individual or custom appearance is desired. It thus can be seen that the types of flooring which are commercially available are generally unsuited to applications in which it is desired to achieve custom appearance.

It has been known, of course, that a flooring substrate can be stenciled or painted by hand, such as when standard basketball court markings are applied to wooden flooring of a gymnasium. Such a process is extremely laborious, and the floor that results from the process or other such processes is generally highly susceptible to wear. Moreover, the quality of the resulting image is limited by the manual artistic skills of the artists involved.

It thus desired to provide an improved floor and associated method in which the floor includes an image that is visible from above the floor. The image could provide a custom appearance and preferably could include one or more of designs, patterns, pictures, symbols, and the like, and also preferably would be highly durable and suited to withstand the environment in which the floor is placed.

SUMMARY OF THE INVENTION

An improved floor and associated method in accordance with the present invention meets these needs and others.

Such a floor includes a substrate and an image, with the image being visible from above the floor. The image is formed on a carrier sheet that is embedded within a coating disposed upon an upper surface of the substrate. The coating is substantially translucent and is highly durable. The carrier sheet becomes substantially invisible when embedded in the coating such that the image remains visible from above the floor and appears to be embedded therein. An associated method is also disclosed.

An aspect of the present invention is to provide an improved floor that includes an image.

Another aspect of the present invention is to provide an improved floor that can be configured to have a custom appearance.

Another aspect of the present invention is to provide an improved floor that is highly resistant to wear.

Another aspect of the present invention is to provide an improved floor that is capable of being individually tailored to meets specific needs.

Another aspect of the present invention is to provide an improved method of forming a floor that includes an image which is visible from above the floor.

Another aspect of the present invention is to provide an improved method of forming a floor in which a preexisting substrate can be retrofitted to include an image and thereby form an improved floor, with the image being visible from above the floor.

These aspects and others are achieved by an improved floor in accordance with the present invention, the general nature of which can be stated as including a substrate having an upper surface, a substantially translucent and solid coating disposed on at least a portion of the upper surface, a carrier sheet covered by the coating, and the carrier sheet including an image, at least a portion of which is visible through the coating from above the floor.

Other aspects of the present invention are met by an improved method of forming a floor, with the floor including an image that is visible from above the floor, wherein the general nature of the method can be stated as including the steps of applying a coating to a substrate, providing a carrier sheet that includes the image, placing the carrier sheet in contact with the coating, and curing the coating to retain the carrier sheet in contact with the coating.

BRIEF DESCRIPTION OF THE DRAWINGS

A further understanding of the invention can be gained from the following Description of the Preferred Embodiment when read in conjunction with the accompanying drawings in which.

Similar numerals refer to similar parts throughout the specification.

DESCRIPTION OF THE PREFERRED EMBODIMENT

Figure 1:
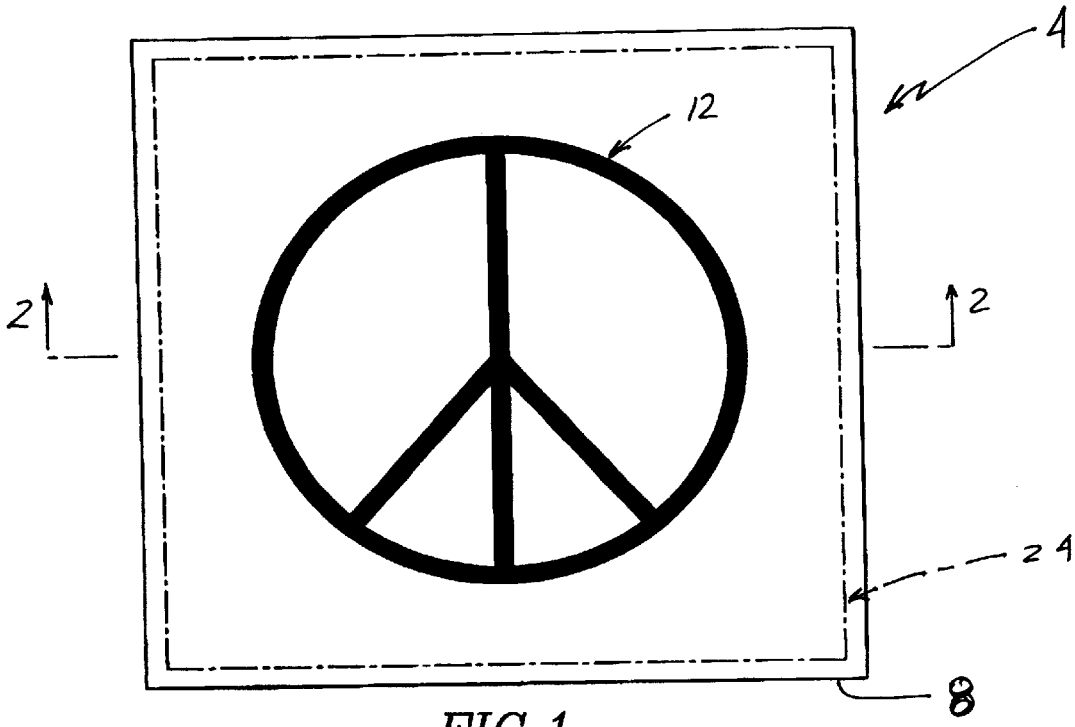
FIG. 1 is a top plan view of a floor in accordance with the present invention.
Figure 2:
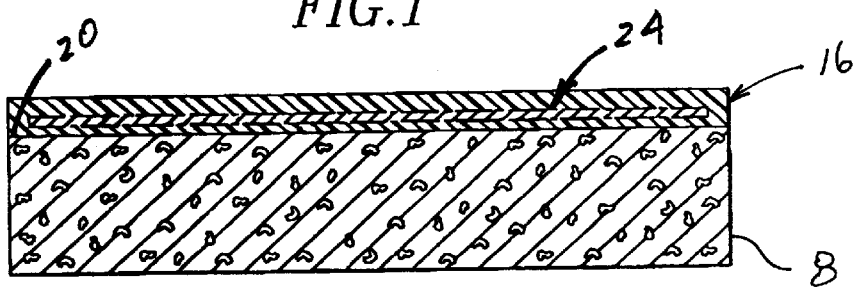
FIG. 2 is a sectional view as taken along line 2—2 of FIG. 1.
Figure 3:
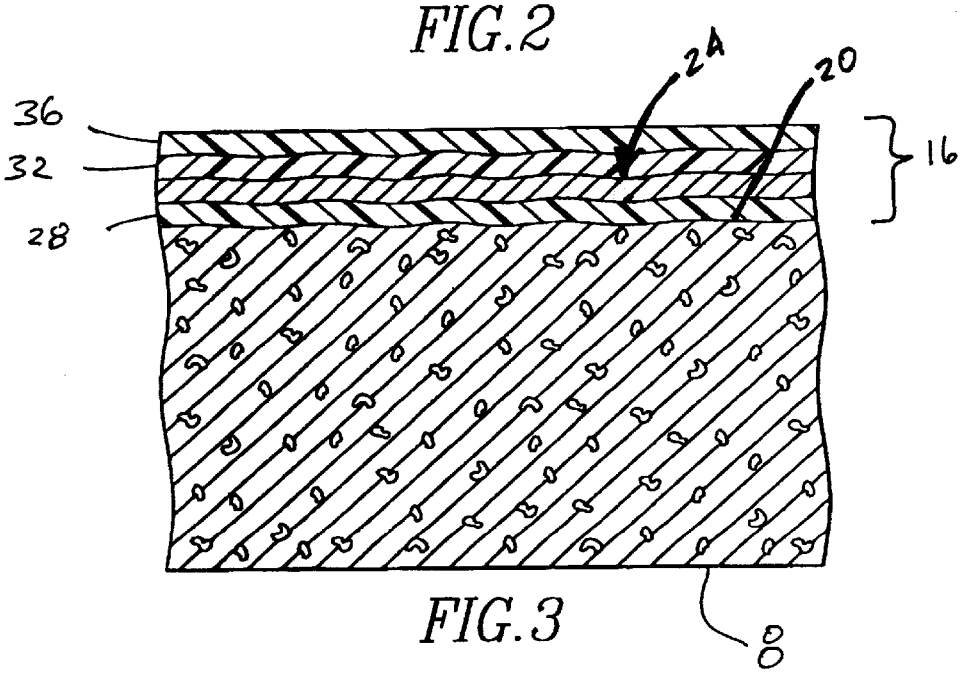
FIG. 3 is an enlarged view of a portion of FIG. 2.
Figure 4:
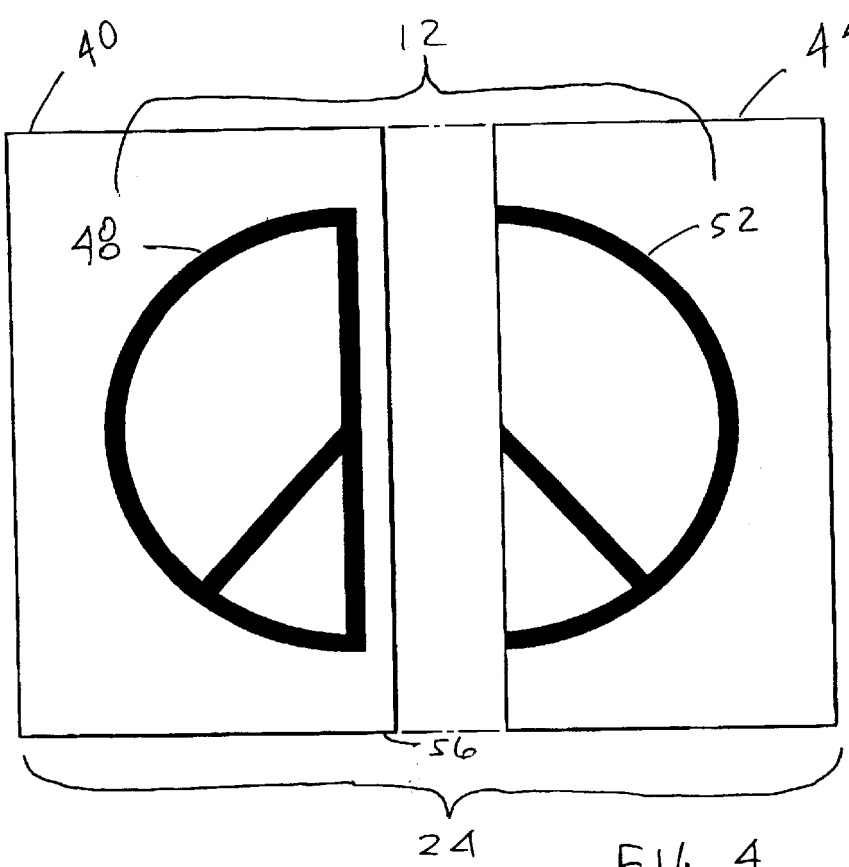
FIG. 4 is an exploded view of a carrier sheet of the floor of the present invention.
Figure 5:
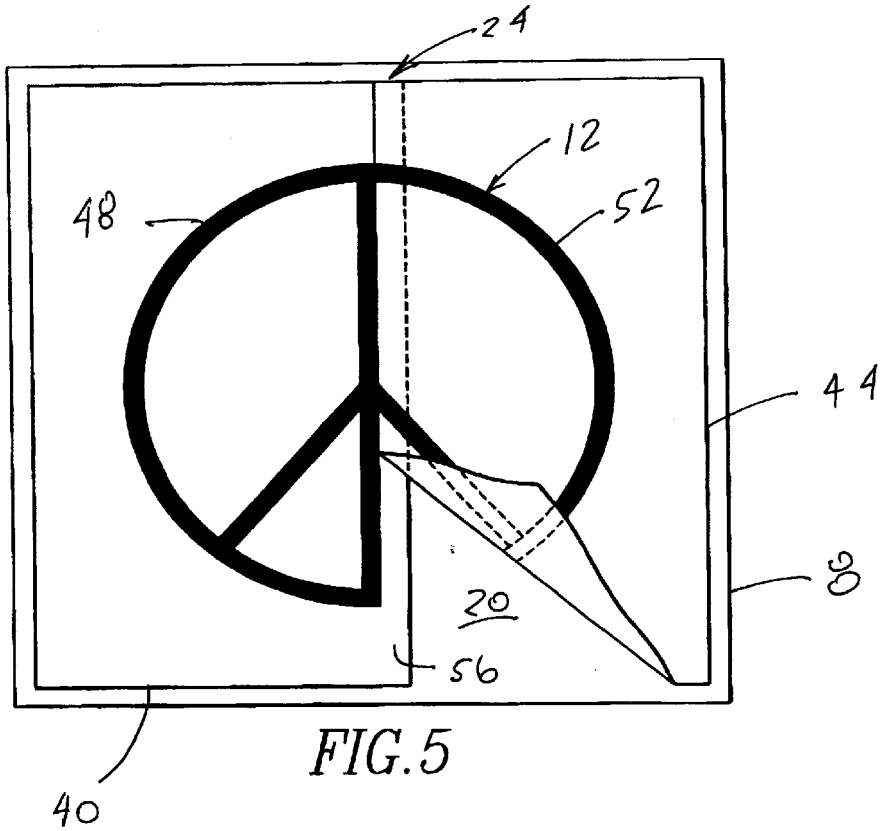
FIG. 5 is a top plan view of the carrier sheet disposed atop a substrate of the floor during assembly of the floor.

A floor 4 in accordance with the present invention is indicated generally in FIGS. 1–3, and components of the floor 4 are indicated in FIGS. 4 and 5. The floor 4 can be generally stated as including a substrate 8 and an image 12, with the image 12 being visible to an observer from above the floor 4. As will be set forth more fully below, the image 12 advantageously can be configured to have virtually any appearance, including a custom appearance. Moreover, and as will likewise be set forth more fully below, the floor 4 is highly wear resistant to promote the enduring integrity and visibility of the image 12.

The floor 4 more particularly includes a coating 16 disposed upon an upper surface 20 of the substrate 8, with the image 12 being covered by the coating 16. Still more specifically, the image 12 is formed on a carrier sheet 24 that is covered by the coating 16.

The image 12 can be printed or otherwise formed on the carrier sheet 24. When the carrier sheet is covered by the coating 16, the carrier sheet 24 advantageously becomes substantially invisible. As such, substantially only the image 12 and those regions of the substrate 8 that are not obscured by the image 12 remain visible from above the floor 4, with the carrier sheet 24 being substantially unseen.

The substrate 8 can be any of a wide variety of known materials such as cementitious materials, wood, and the like. It is preferred that the substrate 8 be substantially dimensionally stable and be disposed in an environment where there is a generally minimal likelihood that substantial quantities of water will be porously transported therethrough.

It is understood that the substrate 8 may be a preexisting structure, meaning that the coating 16 and the carrier sheet 24 can be retrofitted to a substrate 8 that has already been in existence for a period of time to form the floor 4. As such, the substrate 8 need not be newly constructed or custom manufactured in order to be able to provide the substrate 8 with the image 12 to form the floor 4.

Depending upon the condition of the substrate 8, it may be desirable or necessary to level the substrate 8 by application of a self-leveling material to the substrate 8 prior to application of the coating 16. An appropriate self-leveling material would be SDT (Self Drying Topping) manufactured by Ardex Engineered Cements of Aliquippa, Pa., USA. Such material is Portland cement-based and includes powdered acrylic materials and other materials to promote flowability and to allow it to set up quickly. While such a self-leveling material is not explicitly depicted in FIGS. 1–5, it is understood that the substrate 8 incorporates such material if needed prior to application of the coating 16.

The coating 16 can be any of a wide variety of materials that can be applied to the substrate 8 and, after curing, form a substantially translucent, tough, wear resistant member that is adhered to the substrate 8 and that retains the carrier sheet 24 therein. The coating 16 is of a thickness in the range of about 0.024 inches to 0.032 inches although other thicknesses up to 0.050 inches or thicker may be appropriate depending upon the materials used in forming the coating 16. As used herein, the term translucent means capable of transmitting light therethrough with or without distortion. The coating 16 may also be transparent which, as defined herein, means capable of transmitting light therethrough substantially without distortion. The term curing and variations thereof refers to a change in material properties, such as changing from a liquid to a solid or other change, whether automatically as by the allowance of setting or with an outside driving effect such as time, temperature, pressure, and the like.

The exemplary coating 16 depicted in FIGS. 2 and 3 includes a first layer 28, a second layer 32, and a finish layer 36. One or more of the first, second, and finish layers 28, 32, and 36 may be of the same material, or they may be of different materials that are compatible with one another. The first, second, and finish layers 28, 32, and 36 may all be manufactured of a material such as 100% solids epoxy floor coating, which is available under the name Colorseal 100% Solids Clear from Polybond of Greensboro, N.C., USA, and under the name Epoxal 100 WH from Niagara Protective Coatings of Niagara Falls, Ontario, Canada. Such material is a two-component material, whereby after mixing the two components, the resulting mixture cures into a virtually clear tough and wear-resistant material. Other materials may be used for any of the first, second, and finish layers 28, 32, and 36 depending upon the needs of the application and the desired final properties of the floor 4.

The carrier sheet 24 can be any of a wide variety of materials that are suited to having the image 12 formed thereon and that become substantially invisible when covered by the coating 16. One example of an appropriate material for the carrier sheet 24 is Polysilk Soft Cloth which is a 100% polyester knit cloth that is available from Roland DGA Corporation of Irvine, Calif., USA. As used herein, the term cloth shall refer to a flexible material made usually by weaving or knitting natural or synthetic fibers and/or filaments. Success has been achieved using such product in a 15 mil (0.015 inch) thickness and having a basis weight of 190 $g/m^2$. Another appropriate material is Trevria Polyester Flag Cloth, product # 3743, 3.25 ounce, available from American Hoechest. Such cloth products are particularly useful in the present application since such materials are flexible yet substantially dimensionally stable, meaning that they generally do not stretch. It is understood that other appropriate cloth and non-cloth materials may be employed for the carrier sheet 24.

The image 12 may be formed on the carrier sheet 24 by numerous methods including printing, such as by silk screen printing, or by computer controlled applications of pigments, dyes, and the like, such as with the use of an ink jet printer. As used herein, the term printing and variations thereof refers to all conventional types of applications of pigments, dyes, inks, and the like, as well as to any type of deposition of pigments, dyes, inks, and the like in any type of pattern or design onto the carrier sheet 24. Any type of pigment, dye, ink, and the like that is employed in forming the image preferably is light-fast, meaning that it does not fade or become altered over time in the presence of light. It will be appreciated that the image 12 can be formed on the carrier sheet in other fashions such as by weaving the image 12 into the carrier sheet 24 with different colored threads, by hand application of inks, and other such methods.

As is best shown in FIGS. 4 and 5, the exemplary carrier sheet 24 includes a first sub-sheet 40 and a second sub-sheet 44 that partially overlap one another when incorporated into the floor 4. The first sub-sheet 40 includes a first image portion 48 formed thereon, and the second sub-sheet 44 includes a second image portion 52 formed thereon. The first sub-sheet 40 additionally includes an overlap region 56 at one side thereof that is overlapped by a portion of the second sub-sheet 44.

It can be seen that the first and second image portions 48 and 52 together form the image 12. It thus can be seen that the image 12 spans or extends across both the first and second sub-sheets 40 and 44.

As can be seen in FIGS. 4 and 5, the first image portion 48 on the first subsheet 40 terminates at the overlap region 56. As such, when the second sub-sheet 44 overlaps the overlap region 56 of the first sub-sheet 40, the first and second image portions 48 and 52 are disposed adjacent one another and thus appear to form the image 12 in a contiguous fashion. While the overlapping of the first and second subsheets 40 and 44 helps to make the first and second image portions 48 and 52 appear to be contiguous, and to thus form a continuous image 12, other embodiments of the floor 4 (not shown) may not employ such overlapping. For instance, the first and second sub-sheets 40 and 44 could be butted against one another or could have specially shaped abutting edges that are configured to interlock with one another.

Depending upon the size of the floor 4 and size and complexity of the image 12, it may be desirable to form the carrier sheet 24 with many more sub-sheets than are depicted in FIGS. 4 and 5. Such numerous sub-sheets can have multiple and different overlapping relationships with one another.

In order to form the floor 4, it is necessary to form or otherwise provide a substrate 8. As indicated above, the substrate 8 may include a self-leveling material. It is understood, however, that the substrate 8 could be intentionally sloped, such as ramp.

The substrate 8 is preferably cleaned so as to be substantially free of dust and other contaminants. Additionally, it is preferred that the substrate 8 be in a substantially clean or contaminant-free environment. For instance, if the substrate 8 is within a structure that is under construction, it may be desirable to apply the coating 16 with the carrier sheet 24 covered thereby to form the floor 4 during a weekend or other period when dust and other air-borne contaminants are not being produced by other work being done on the structure.

The first layer 28 is applied to the upper surface 20 of the substrate. The first layer 28 may be applied by a roller or other appropriate device that is coated with the material that makes up the first layer 28.

While the first layer 28 is still uncured, the carrier sheet 24 is placed on top of and is pressed into the first layer 28. In this regard, the first and second sub-sheets 40 and 44 (or other such multiple sub-sheets as appropriate) are applied to the first layer 28 in an appropriate order such that proper overlapping of the overlap region 56 by the second sub-sheet 44 (or other overlap regions with additional sub-sheets as appropriate) is achieved. While the first layer 28 is still in an uncured state, the first and second sub-sheets 40 and 44 can be adjusted for proper orientation and positioning of the image 12 as well as for proper positioning of the first and second image portions 48 and 52 with respect to one another such that they form a continuous image 12. The first layer 28 is of a thickness in the range of about 0.008 inches to 0.010 inches.

Once the carrier sheet 24 is appropriately positioned, and preferably prior to curing of the first layer 28, the second layer 32 is applied over the carrier sheet 24. The second layer 32 can be applied with the same roller or other device that was used to apply the first layer 28, if appropriate. The use of a roller is particularly advantageous in applying the second layer since such a roller additionally presses the carrier sheet 24 downward into the first layer 28 and against the substrate 8. The second layer 32 is of a thickness in the range of about 0.008 inches to 0.010 inches. The first layer 28 is of a similar thickness to the second layer 32, although this is not considered critical to the proper formation of the floor 4.

It thus can be seen that the carrier sheet 24 can also be said to be embedded in the coating 16. As used herein, the expression "embedded" is intended to refer to a first member being disposed internally within a second member such that the second member surrounds the first member and extends beyond all surfaces thereof. In the present circumstance, the quantity of material of the first layer 28 that extends beyond the carrier sheet 24 and is interposed between the carrier sheet 24 and the upper surface 20 of the substrate 8 may be minimal, but in the embodiment depicted in the accompanying figures is of a non-zero thickness. In other embodiments (not shown) however, the carrier sheet 24 potentially could be disposed directly against the upper surface 20 without departing from the concept of the present invention.

In disposing the carrier sheet 24 between the first and second layers 28 and 32, it is understood that at least a portion of at least one of the first and second layers 28 and 32 of the coating 16 is absorbed into or adsorbed to the carrier sheet 24. As such, while the first and second layers 28 and 32 are depicted in FIG. 3 as being discrete, the first and second layers 28 and 32 rather are contiguous and extend through the carrier sheet 24. Such a condition could be substantially achieved even if the first layer 28 was permitted to cure prior to application of the second layer 32.

It can be understood from the foregoing, therefore, that after curing of the first and second layers 28 and 32, the first layer 28 serves as an adhesive layer to adhere the carrier sheet 24 to the substrate 8, and the second layer 32 serves as a sealing and protective layer to protect the image 12 from wear.

After the first and second layers 28 and 32 have cured, the finish layer 36 is applied over the second layer 32 to give the coating 16 a smooth and glass-like outer surface facing outward toward the atmosphere. The finish layer 36 is of a thickness in the range of about 0.008 inches to 0.010 inches. Since the material out of which the first, second, and finish layers 28, 32, and 36 are made may be self-leveling, the finish layer 36 should provide a glass-like outer surface without significant smoothing effort. Depending upon the degree of smoothness of the second layer 32, it may be unnecessary to apply the finish layer 36. Upon curing of the finish layer 36, the floor 4 is complete.

As indicated above, when the carrier sheet 24 is covered by the coating 16, at least a portion of the coating 16 is one of absorbed into and adsorbed to the carrier sheet 24. In so doing, the carrier sheet 24 is rendered substantially invisible or at least very difficult to observe such that substantially only the image 12 and those portions of the substrate 8 not obscured by the image 12 are visible from above the floor 4. The coating 16 is highly wear-resistant such that it both protects the carrier sheet 24 and thus the image 12, and also does not become worn in such a fashion that would obscure the image 12 from view of the observer.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. A floor comprising:

a substrate having an upper surface;

a substantially translucent and solid coating applied to at least a portion of the upper surface;

a carrier sheet embedded in the coating, the coating extending through at least a portion of the carrier sheet; and the carrier sheet including an image, at least a portion of which is visible through the coating from above the floor.

2. The floor of claim 1, wherein the carrier sheet is manufactured at least partially out of a polymeric material.

3. The floor of claim 1, wherein the image is printed on the carrier sheet.

4. The floor of claim 3, wherein the image is a custom image.

5. The floor of claim 1, wherein the carrier sheet includes a plurality of sub-sheets.

6. The floor of claim 5, wherein the image extends across more than one of the sub-sheets.

7. The floor of claim 5, wherein at least one of the sub-sheets at least partially overlap another sub-sheet.

8. The floor of claim 1, wherein at least a portion of the coating is wear-resistant.

9. The floor of claim 1, wherein the coating includes a first layer applied to the substrate and a second layer applied to the first layer, the carrier sheet being disposed generally between the first and second layers.

10. The floor of claim 9, wherein the first and second layers are made of substantially the same material.

11. The floor of claim 9, wherein the coating further includes a finish layer disposed on the second layer.

12. The floor of claim 11, wherein the first layer, second layer, and finish layer are made of substantially the same material.

13. The floor of claim 9, wherein the first and second layers are made of materials that are one of (a) substantially the same as one another and (b) compatible with one another.

14. The floor of claim 1, wherein at least a portion of the coating is one of absorbed into and adsorbed to the carrier sheet.

15. The floor of claim 1, wherein the image is substantially completely visible from above the floor.

16. A floor comprising:

a substrate having an upper surface;

a substantially translucent and solid coating disposed on at least a portion of the upper surface;

a carrier sheet covered by the coating;

the carrier sheet including an image, at least a portion of which is visible through the coating from above the floor; and wherein the carrier sheet is at least partially translucent.

17. The floor of claim 16, wherein the carrier sheet is substantially transparent.

18. The floor of claim 17, wherein the carrier sheet is substantially invisible from above the floor.

19. A floor comprising:

a substrate having an upper surface;

a substantially translucent and solid coating disposed on at least a portion of the upper surface;

a carrier sheet covered by the coating;

the carrier sheet including an images at least a portion of which is visible through the coating from above the floor; and wherein the carrier sheet is manufactured at least partially of a cloth.

20. The floor of claim 19, wherein the cloth is a knit cloth.

21. A method of forming a floor having an image that is visible from above the floor, the method comprising the steps of:

applying a coating to a substrate;

providing a carrier sheet that includes the image;

extending the coating through the carrier sheet; and curing the coating to retain the carrier sheet embedded in the coating with portions of the coating overlying the carrier sheet.

22. The method of claim 21, wherein the step of applying a coating to a substrate includes the steps of applying a first layer to the substrate and applying a second layer to the carrier sheet.

23. The method of claim 22, wherein the step of applying a second layer to the carrier sheet includes placing the carrier sheet in contact with the first layer of the coating.

24. The method of claim 22, wherein the step of applying a coating further includes the step of applying a finish layer to the second layer.

25. The method of claim 21, further comprising disposing the carrier sheet generally between a first layer and a second layer of the coating.

26. The method of claim 21, further comprising absorbing at least a portion of the coating into the carrier sheet.

27. The method of claim 21, wherein the step of providing a carrier sheet includes the step of providing a plurality of sub-sheets.

28. The method of claim 27, further comprising at least partially overlapping one of the sub-sheets with another sub-sheet.

29. The method of claim 21, wherein the step of providing a carrier sheet includes the step of printing the image onto the carrier sheet.

30. The method of claim 21, further comprising the step of making the coating substantially transparent.

31. A method of forming a floor having an image that is visible from above the floor, the method comprising:

applying a coating to a substrate;

providing a carrier sheet that includes the image;

placing the carrier sheet in contact with the coating;

curing the coating to retain the carrier sheet in contact with the coating; and making the carrier sheet substantially invisible.

32. The method of claim 31, further comprising adding an additional layer of the coating above the carrier sheet subsequent to placing the carrier sheet in contact with the coating but prior to curing of the coating.

* * * * *

UNITED STATES PATENT AND TRADEMARK OFFICE

CERTIFICATE OF CORRECTION

PATENT NO. : 6,802,164 B1
DATED : October 12, 2004
INVENTOR(S) : Bruce E. Newbrough et al.

It is certified that error appears in the above-identified patent and that said Letters Patent is hereby corrected as shown below:

Title page,
Item [75], Inventors, add -- Frank Sanau, Witten, Germany --.
Item [56], References Cited, OTHER PUBLICATIONS, first reference, add -- " -- prior to "Footprint,".

Column 8,
Line 1, delete "images" add -- , -- after "image".

Signed and Sealed this

Twenty-second Day of February, 2005

JON W. DUDAS
*Director of the United States Patent and Trademark Office*